US006006009A

United States Patent [19]

Friedheim

[11] Patent Number: 6,006,009

[45] Date of Patent: Dec. 21, 1999

[54] SUPERHEATED VAPOR GENERATOR SYSTEM

[76] Inventor: Max Friedheim, 2036 Emerald St., San Diego, Calif. 92109

[21] Appl. No.: 08/654,968

[22] Filed: May 24, 1996

[51] Int. Cl.[6] ..... A01G 13/06; F22B 1/28; H05B 3/02; F22G 5/00

[52] U.S. Cl. ..... 392/400; 392/386; 219/476; 122/479.1

[58] Field of Search ..... 392/394, 396, 392/397, 398, 399, 386, 387; 219/476, 477, 479, 480, 483; 122/40, 460, 466, 467, 479.1

[56] References Cited

U.S. PATENT DOCUMENTS

| | | | |
|---|---|---|---|
| 1,678,995 | 7/1928 | Maxim et al. | 219/477 |
| 2,064,654 | 12/1936 | Gannon | 219/480 |
| 2,266,252 | 12/1941 | Osterheld | 219/477 |
| 2,958,755 | 11/1960 | Miller | 219/480 |
| 3,083,288 | 3/1963 | Vischer, Jr. | 219/477 |
| 3,453,415 | 7/1969 | Hermes et al. | 219/480 |
| 4,414,037 | 11/1983 | Freidheim | 392/399 |
| 4,818,843 | 4/1989 | Swiatosz | 392/397 |
| 4,954,147 | 9/1990 | Shroyer | 219/477 |

*Primary Examiner*—Sam Paik
*Attorney, Agent, or Firm*—Evanns & Walsh; Joseph R. Evanns

[57] ABSTRACT

A superheated vapor generator system comprises at least two vapor generators connectable to a controller for causing at least one of the superheated vapor generators to generate superheated vapor during a time interval in which the at least one other superheated vapor generator does not generate superheated vapor whereby at least one superheated vapor generator produces superheated vapor as desired during a selected time interval. The system may be adjusted to generate vapor substantially continuously.

25 Claims, 3 Drawing Sheets

SUPERHEATED VAPOR GENERATOR SYSTEM

FIELD OF THE INVENTION

The invention pertains to a system of superheated vapor generator units interconnectable and controllable to provide desired flows of superheated vapor, including substantially continuous flows.

DESCRIPTION OF THE PRIOR ART

Prior patents include U.S. Pat. No. 5,471,556 and U.S. Pat. No. 4,414,037, owned by the inventor and applicant herein, co-pending U.S. Pat. application Ser. No. 08/484,019 owned by the applicant and inventor herein for Superheated Vapor Generator and Control System and Method (incorporated by reference herein), references cited in connection with aforesaid U.S. Pat. No. 4,414,037 including U.S. Pat. Nos. 2,505,656; 2,753,212; 2,861,838; 2,983,450; 3,039,454; 3,218,741; 3,718,805 and 3,721,802, and patents cited in connection with said U.S. Pat. No. 5,471,556 including U.S. Pat. Nos. 377,228; 2,652,645; 3,436,852; 3,119,004; 3,869,815; 4,255,646; 3,508,354; 3,823,497; and 2,576,976.

The aforesaid references in the main refer to apparatus and methods for generating steam from liquid drawn from a reservoir.

U.S. Pat. No. 4,414,037 (the '037 Patent) discloses apparatus for generating superheated steam or other vapor from liquid drawn from a self-contained reservoir and includes means in the form of a nozzle for directing superheated steam or other vapor to desired places. U.S. Pat. No. 5,471,556 discloses improvements relative to the '037 Patent Said co-pending application discloses further improvements.

Equipment disclosed in the aforesaid patents and co-pending application is employable for effecting, among other things, cleaning and/or sterilization. This apparatus has proved highly useful for such purposes. In operation, such equipment provides bursts of superheated vapor upon activation of a control member. Duration and frequency of such bursts was limited by the recovery time of the vapor generator. This is the time required for the temperature of the vapor generator to recover to the operating level after inflow of unheated fluid/liquid into the vapor generator prior to vaporization into superheated vapor. As prescribed by the laws of thermodynamics, the very rapid and substantial transfer of heat from the walls of the generator to the liquid in the process of vaporization, causes a decrease in temperature of the vaporization chamber and its walls reducing the temperature to the point where rapid generation of superheated vapor is required to cease. Methods and devices described and claimed in the aforesaid patents and application facilitate speedy reheating of the vaporization chamber.

Many applications, however, call for flows of superheated vapor of longer duration or greater frequency and even for flow of superheated vapor on a substantially continuous basis as, for example, in connection with vapor-powered engines, among other applications.

Therefore, there has been a felt but unfulfilled need for a vapor generating system having a capability of providing relatively long-duration and/or higher frequency flows of superheated vapor and for providing substantially continuous flow of superheated vapor upon demand.

SUMMARY OF THE INVENTION

A superheated vapor generator system comprises at least two vapor generators connectable to controller means for causing at least one of said superheated vapor generators to generate superheated vapor during a time interval in which said at least one other superheated vapor generator does not generate superheated vapor whereby at least one superheated vapor generator produces superheated vapor as desired during a selected time interval. Said superheated vapor generator system may be adjusted to generate vapor substantially continuously.

DETAILED DESCRIPTION OF THE INVENTION AND DESCRIPTION OF A PREFERRED EMBODIMENT

Figure 1:
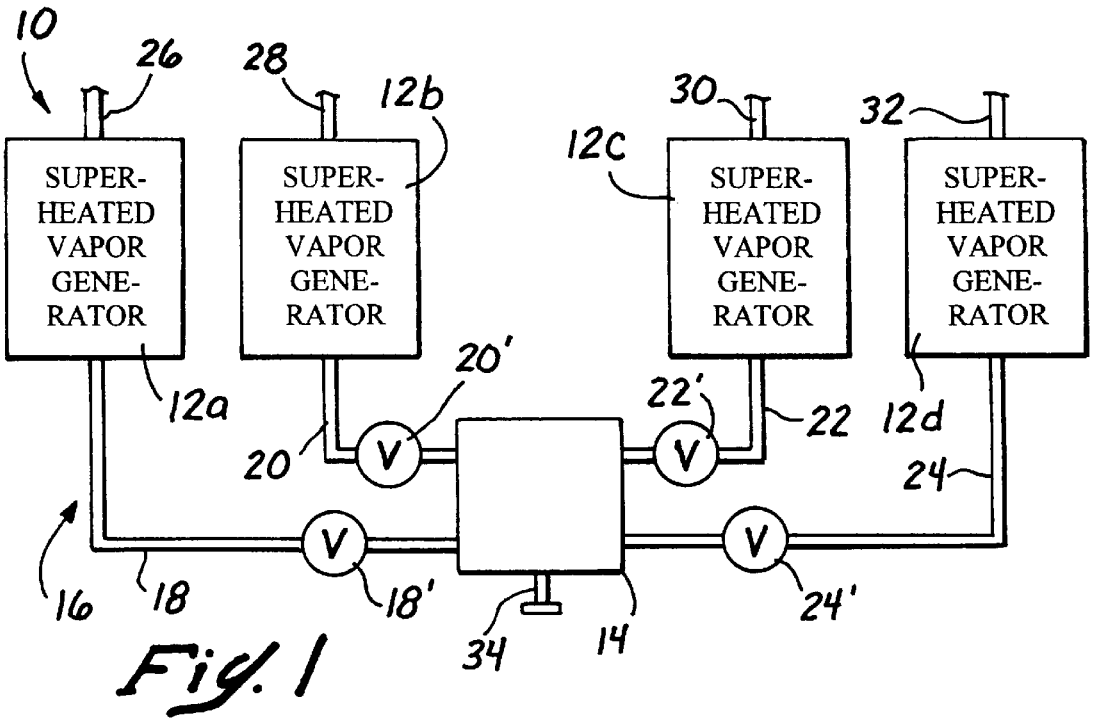
FIG. 1 is a view, somewhat schematic, of a superheated vapor generator system in accordance with the invention.

As depicted in FIG. 1, a superheated vapor generator system 10 in accordance with the invention comprises a plurality, in the depicted embodiment four, of superheated vapor generators 12*a*, 12*b*, 12*c*, and 12*d*. Vapor generators 12*a*–12*d* are coupled to an output manifold collector assembly 14 by a conduit system 16.

Superheated vapor generators 12*a*–12*d*, and each of them, are in accordance with the superheated vapor generators described and claimed in U.S. Pat. No. 4,414,037 to the inventor herein, as is discussed in further detail hereinbelow. Manifold system conduit section 18 connects the output of superheated vapor generator 12*a* to manifold 14; conduit section 20 connects vapor generator 12*b* to manifold 14; conduit section 22 connects vapor generator 12*c* to manifold 14, and conduit section 24 connects vapor generator 12*d* to manifold 14. Check valves 18', 20', 22', and 24', are positioned in conduit sections 18, 20, 22, and 24, respectively, to prevent backflow of superheated vapor generated from the superheated vapor generators 12*a*–12*d*.

Intake conduits 26, 28, 30, 32 connect generators 12*a*, 12*b*, 12*c*, 12*d*, respectively, to a source of liquid (not shown) for use in vaporization by the generators.

Connected to the manifold 14 is an output conduit 34 for issuance of superheated vapor generated by vapor generators 12*a*–12*d* and collected in manifold 14. In particular applications, output 34 constitutes a hose, a pipe, and the like, or may constitute a nozzle connectable to a vapor controller of the type described and claimed in U.S. Pat. No. 5,471,556 issued Nov. 28, 1995 to the inventor herein and incorporated by reference herein.

Figure 2:
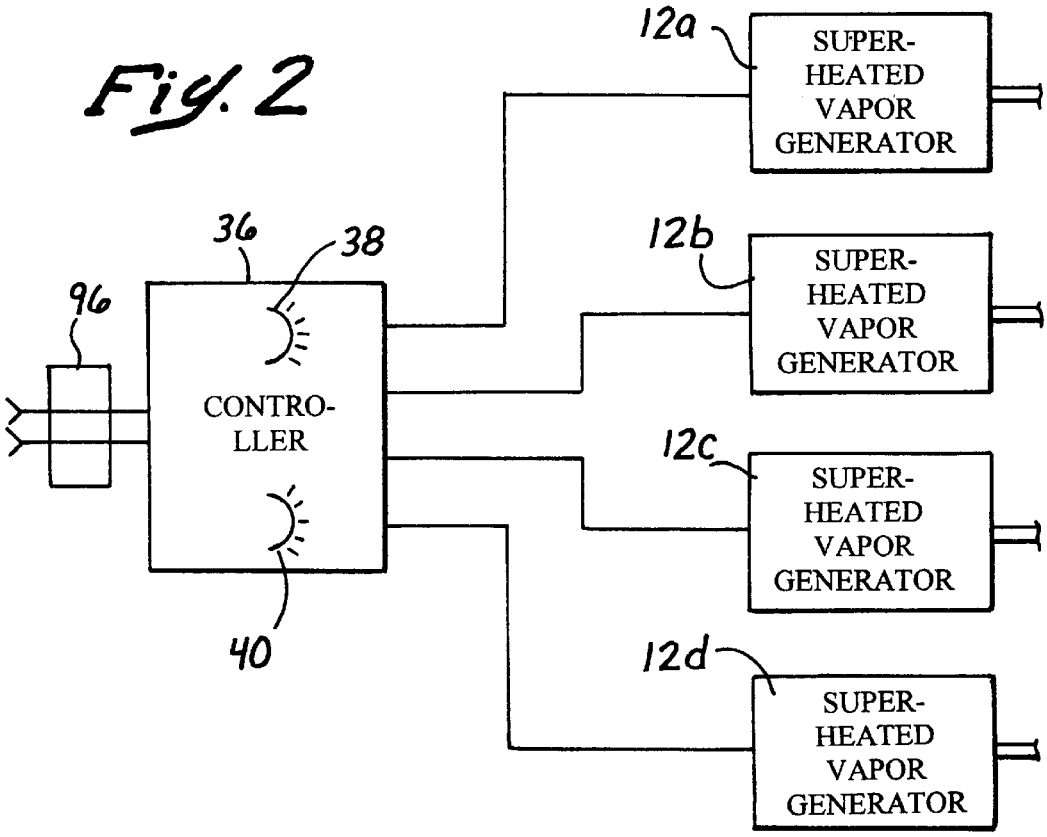
FIG. 2 is a schematic diagram of a control of the superheated vapor generator system of FIG. 1.

Referring to FIG. 2, depicted therein is a control system 36 for vapor generator systems in accordance with the invention. Controller 36 comprises a logic "smart box" of conventional type having an offperiod control switch 38 and an on period control switch 40. Controller 36 is electrically connected to vapor generators 12*a*, 12*b*, 12*c*, 12*d*, in parallel wiring. The setting of switch 38 determines the time interval during which each generator 12 is "off" per cycle and switch 40 determines the time interval which generators 12 are "on" as described in further detail below.

Figure 3:
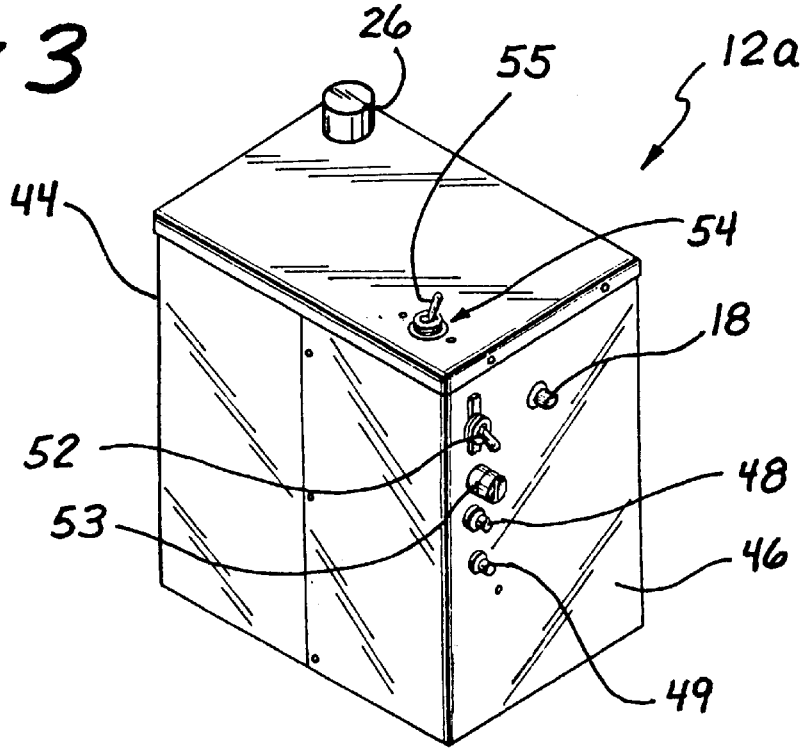
FIG. 3 is a perspective view, somewhat simplified, of a superheated vapor generator unit employed in the system of FIG. 1.
Figure 4:
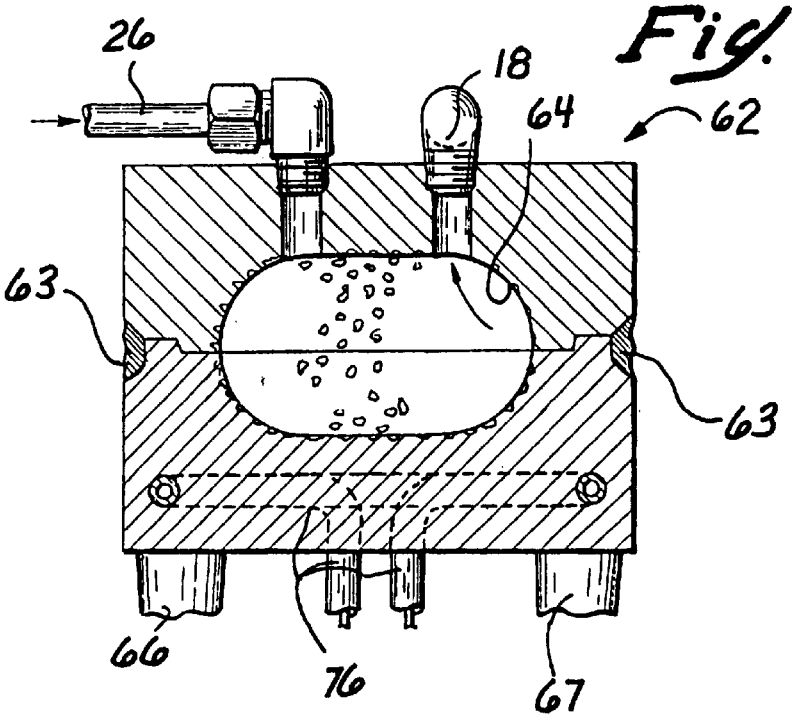
FIG. 4 is a side view, somewhat simplified and partly in section, of the superheated vapor generator of FIG. 3.

Referring to FIG. 3, depicted therein is a superheated vapor generator 12*a*. As noted above, the superheated vapor generators 12*a*–12*d* are identical; thus, the description herein of one of the units is provided. In addition, the superheated vapor generator 12*a* is that which is described and claimed in U.S. Pat. No. 4,414,037 incorporated by reference herein and as a result the description herein will be brief.

The superheated vapor generator 12*a* has the capability as fully described in '037 patent of rapidly generating flows of superheated vapor, including steam. Generator 12*a* includes a housing 44. Intake conduit 26 is depicted in fragmentary form extending from housing 44. Output conduit 18 extends from the front panel 46 of housing 44.

Indicator light 48 mounted on panel 46 indicates that the power is on and is part of the system circuitry shown in FIG. 5 and discussed in connection therewith. Switch 52 mounted on panel 46 and connected to the system circuitry comprises an on-off switch for power to the heating element of generator 12*a*. Switch 54 with handle 55 on housing 44 controls activation of a pump 88 for supplying liquid to generator 12*a*. Switch 54 is controlled by controller 36 as well as being manually operable by handle 55. In particular applications of the invention, a single pump with multiple ports connected to vapor generators 12A–12D may be employed to serve a plurality of generators.

Generator 12*a* comprises a flash boiler 62 for rapidly vaporizing liquid and pump 88 (shown schematically only in FIG. 5) for providing liquid to the boiler. The boiler and pump are preferably those described and depicted in the '037 Patent or alternatively the '556 Patent incorporated by reference herein. Thus, the description here will be brief. Boiler 62 comprises a thermally conductive pair of metal castings welded together at 63 and defining an internal vaporization chamber 64. As in the '037 Patent, the chamber surface is irregular, here shown as etched, for enhanced rapidity and efficiency of vaporization. Boiler 62 is supported on legs 66,67. An electric heating element 76 is disposed within the generator body and is under control of switch 52. Liquid from a reservoir (not shown) is provided to chamber 64 through inlet conduit 26. Vapor is issued from chamber 64 through outlet conduit 18.

Figure 5:
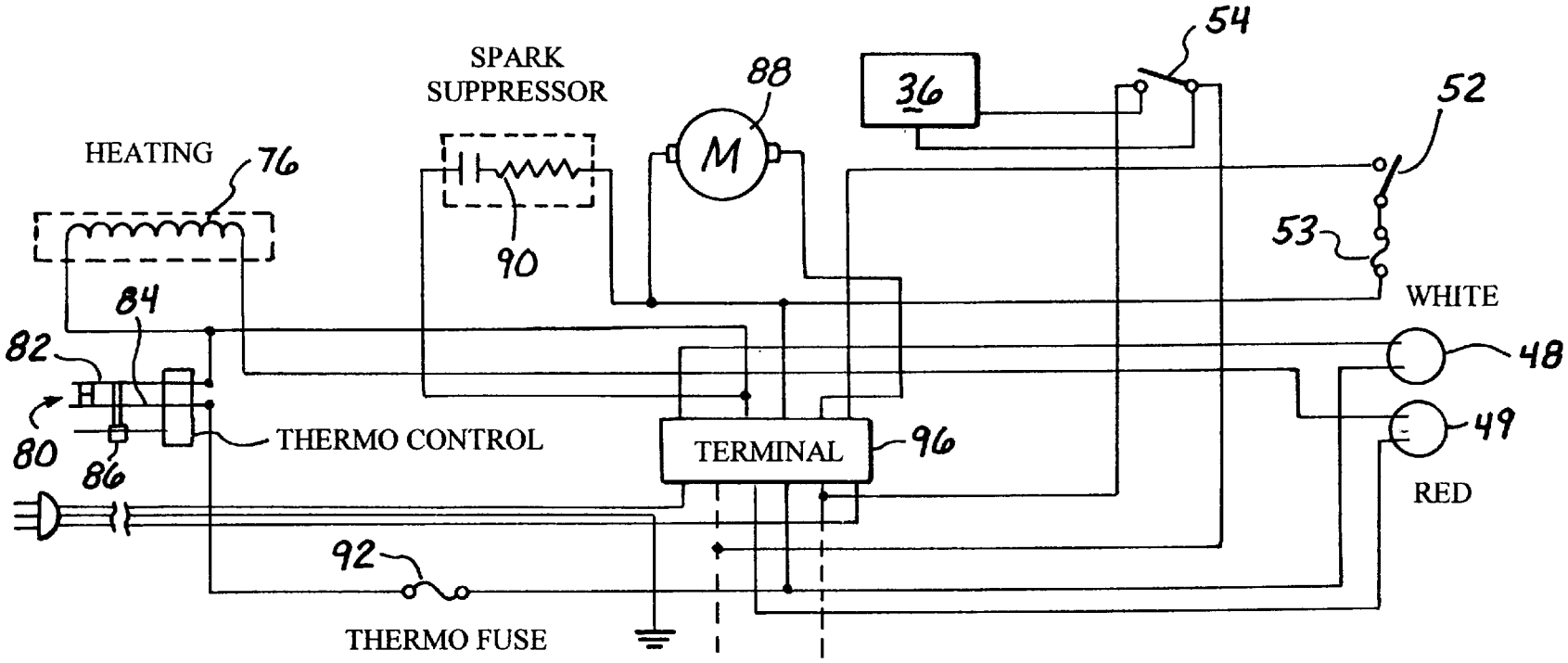
FIG. 5 is a simplified circuit diagram of the superheated vapor generator system of FIG. 1.

Referring now to FIG. 5, switch 52 turns on and off heating element 76 which in turn is controlled by a thermocontroller 80 which may be in the form of a thermostat, thermocouple, or other such conventional thermal control device, to provide the preferred operating temperature of generators 12*a*–12*d*, which as stated in the '037 Patent, is substantially equal to 550 Degrees Fahrenheit. White light 48 is on whenever power is on and red light 49 is on when the boiler 62 is energized for vaporization. Switch 54 turns on and off pump 88.

Thermostat 80 includes blades 82,84 mounted on generator 12*a* by an electrical connector (not shown). Setting of thermostat 80 is accomplished by adjusting a screw 86. Spark suppressor 90 helps to prevent thermostat 80 from arcing or freezing. A thermofuse 92 is thermally connected to generator 12*a* and discharges to break the generator heating circuit at preset temperature (700 degrees F. as in the '037 Patent) in the event of failure of thermostat 80 and spark suppressor 90. A terminal 96 connects to an external power source (not shown).

In operation, the timer controller 36 is set for: the desired intervals of operation (that is, pumping of liquid to the generator for vaporization providing superheated vapor output from the generator) for each generator 12*a*–12*d;* for the desired sequence of operation of the respective generators; and for the period of time between the activation of a particular generator in one cycle and its activation in the next cycle. This is accomplished by adjustment of switches 38,40.

A liquid reservoir (not shown) is filled with the liquid desired to be vaporized at superheated temperature ranges of the generators 12*a*–12*d*. In many instances, discussed in detail in the '037 Patent and '556 Patent, the liquid may be water, mixed or unmixed with other compounds, for such applications as cleaning and disinfection , among numerous applications. Lubricant liquids may be employed where lubrication is to be performed. Under the present invention, the superheated vapor generator system may be employed for the application of a superheated vapor engine as, for example, a steam engine. This is due to the capability of the invention for producing substantially continuous output of superheated vapor on the part of the system of this invention.

A power switch 96 connected to a source of external power (not shown) is turned to the "on" position. At this point, the first generator in the selected sequence, 12*a*, is caused to produce superheated vapor by activation of of pump 88 supplying liquid to generator 12*a*. In a typical cycle, generator 12*a* will produce output superheated steam for four (4) seconds and will be set to repeat this operation twelve (12) seconds after cessation of emission of steam or sixteen (16) seconds after commencement of output of steam.

In the 12 seconds of downtime for generator 12*a*, generators 12*b*, 12*c*, 12*d* are performing the identical operation described for generator 12*a* ; concurrently for at least a part of its downtime, generator 12*a* is in a "recovery phase" in which its temperature, reduced by the heat loss from vaporization of water producing steam in its active phase, is raised once again to operating temperature, at which point generator 12*a* is ready to produce additional steam in the next cycle. Of course, this series of events is identical for each generator 12*a*–12*d*.

Superheated steam produced by the invention is supplied to manifold collector 14 via output conduits 18,20,22,24 for generators 12*a*, 12*b*, 12*c*, 12*d*, respectively.

The amount of downtime, length of time on, pressure and volume of output vapor , are parameters of the system 10. For example, if additional steam per unit time is desired, the operating cycle may be shortened or additional generator units may be added; such addition of units may be in "parallel" with existing arrangement of generators to operate concurrently in the existing sequence, thereby maintaining timing of the existing cycle, or in series, whereby the cycle will be lengthened.

In the foregoing manner, generation of superheated vapor can be accomplished under precise control for numerous applications where a substantially continuous flow of output vapor is desired as, for example, in operation of a steam-powered engine or generator.

The embodiment depicted and described herein is illustrative of the invention, which is defined solely by the appended claims construed in light of the specification and drawings.

What is claimed is:

1. A superheated vapor generator system comprising:

(1) a first superheated vapor generator having means for output of superheated vapor and being connectable to controller means for controllably supplying to said first superheated vapor generator liquid for vaporization;

(2) at least one superheated vapor generator other than said first-mentioned first superheated vapor generator having means for output of superheated vapor and being connectable to said controller means for controllably supplying to said at least one second-mentioned vapor generator liquid for vaporization; and (3) controller means connectable to said first superheated vapor generator and to said at least one vapor generator other than said first-mentioned first superheated vapor generator and being adjustable to control supply of liquid to said superheated vapor generators such that at least one of said superheated vapor generators produces output of superheated vapor during selected time intervals, each of said first superheated vapor generator and said at least one superheated vapor generator other than said first-mentioned superheated vapor generator producing output of superheated vapor in response to input of liquid.

2. The invention as set forth in claim 1 wherein said control means comprises pump means and timer means, said timer means being adjustable to actuate said pump means and said pump means being actuable to pump liquid supply to said vapor generators.

3. The invention as set forth in claim 2 wherein said pump means comprises at least one pump member for each of said superheated vapor generators.

4. The invention as set forth in claim 2 wherein said timer means is adjustable to control duration of supply of liquid to said superheated vapor generators.

5. The invention as set forth in claim 2 wherein said timer means his adjustable to control frequency of supply of liquid to said superheated vapor generators.

6. The invention as set forth in claim 2 wherein said pump means comprises one pump member.

7. The invention as set forth in claim 1 further including at least one manifold member connectable to the output of said superheated vapor generators.

8. The invention as set forth in claim 1 wherein said control means is adjustable to provide a substantially continuous output flow of superheated vapor from said superheated vapor generators.

9. The invention as set forth in claim 1 including at least one liquid reservoir member for retention of liquid for supply to said superheated vapor generators for vaporization.

10. The invention as set forth in claim 9 further including at least one mobile member and wherein said superheated vapor generators, said control means, and said at least one liquid reservoir member are disposed upon said at least one mobile member whereby said system is rendered mobile.

11. The invention as set forth in claim 1 wherein said controller means is adjustable to control a supply of liquid to said superheated vapor generator such that said first superheated vapor generator and said at least one superheated vapor other than said first mentioned superheated vapor generator produce output of superheated vapor substantially concurrently.

12. The invention as set forth in claim 1 wherein said controller means is adjusted to control supply of liquid to said superheated vapor generators such that said at least one superheated vapor generator and said at least one superheated vapor generator other than said first-mentioned vapor generator produce substantially discrete outputs of superheated vapor.

13. A superheated vapor generator system comprising:

(1) a plurality of superheated vapor generators for producing output of superheated vapor in response to input of liquid, each of said vapor generators being connectable to controller means for controlling output of superheated vapor from said superheated vapor generators such that at least one of said superheated vapor generators produces output when at least one of said superheated vapor generators is not producing output of superheated vapor;

(2) controller means connectable to said superheated vapor generators and adjustable to control output of superheated vapor from said superheated vapor generators whereby duration and frequency of output of said superheated vapor generators are adjustable by controlling supply of liquid to said superheated vapor generators.

14. The invention as set forth in claim 13 further including manifold means for receiving output of superheated vapor prior to discharge thereof to ambient.

15. The invention as set forth in claim 14 wherein said manifold means includes check valve means to prevent backflow of superheated vapor from said manifold means to said superheated vapor generators.

16. The invention as set forth in claim 13 wherein said controller means is adjusted to provide a substantially continuous output of superheated vapor from said vapor generators.

17. The invention as set forth in claim 13 wherein said controller means comprises supply means for supplying liquid for vaporization to said superheated vapor generators.

18. The invention as set forth in claim 17 wherein said controller means further includes timer means for regulating timing of said supply of liquid to said superheated vapor generators.

19. The invention as set forth in claim 18 wherein said timer means is adjusted such that at substantially all times at least one of said superheated vapor generators is providing output of superheated vapor.

20. The invention as set forth in claim 19 wherein said output of said superheated vapor generators is connected to power a drive member whereby said superheated vapor generator system functions as a motor.

21. The invention as set forth in claim 20 wherein said liquid is substantially water and said superheated vapor substantially comprises superheated steam.

22. The invention as set forth in claim 13 wherein said controller means is adjustable to activate said superheated vapor generators in a predetermined sequence.

23. The invention as set forth in claim 13 wherein said controller means is adjustaable to activate said superheated vapor generators with predetermined timing.

24. The invention as set forth in claim 13 wherein said controller means is adjustable to control output of superheated vapor from said superheated vapor generators whereby at least two of said superheated vapor generators produce output of superheated vapor substantially simultaneously.

25. The invention set forth in claim 10 wherein said controller means is adjusted to provide substantially discontinuous output of superheated vapor from said superheated vapor generators.

* * * * *